United States Patent [19]

Zaccaro

[11] Patent Number: 4,856,208

[45] Date of Patent: Aug. 15, 1989

[54] SHOE WITH SOLE THAT INCLUDES INFLATABLE PASSAGES TO PROVIDE CUSHIONING AND STABILITY

[75] Inventor: Carlo Zaccaro, Rome, Italy

[73] Assignee: Treshlen Limited, Douglas, United Kingdom

[21] Appl. No.: 153,937

[22] Filed: Feb. 9, 1988

[30] Foreign Application Priority Data

Feb. 16, 1987 [GB] United Kingdom ..... 8703555

[51] Int. Cl.[4] ..... A43B 13/20; A43B 21/28

[52] U.S. Cl. ..... 36/29; 36/35 B; 36/103

[58] Field of Search ..... 36/29, 28, 35 B, 3 B, 36/3 R, 43, 44, 7.8, 116, 103

[56] References Cited

U.S. PATENT DOCUMENTS

| | | | |
|---|---|---|---|
| 4,183,156 | 1/1980 | Rudy . | |
| 4,577,417 | 3/1986 | Cole | 36/29 |
| 4,676,009 | 6/1987 | Davis et al. . | |

FOREIGN PATENT DOCUMENTS

| | | | |
|---|---|---|---|
| 164069 | 12/1905 | Fed. Rep. of Germany | 36/29 |
| 448945 | 12/1912 | France | 36/29 |
| 72275 | 11/1985 | Taiwan . | |
| 2930 | of 1891 | United Kingdom | 36/29 |
| 16143 | of 1891 | United Kingdom | 36/29 |
| 13911 | of 1892 | United Kingdom | 36/29 |
| 358205 | 10/1931 | United Kingdom . | |
| 390368 | 4/1933 | United Kingdom . | |
| 490647 | 8/1938 | United Kingdom . | |
| 2023405 | 1/1980 | United Kingdom . | |
| 2034169 | 6/1980 | United Kingdom . | |
| 2073006 | 10/1981 | United Kingdom . | |

OTHER PUBLICATIONS

International Patent Publication No. WO82/00571, dated Mar. 4, 1982.

*Primary Examiner*—James Kee Chi

*Attorney, Agent, or Firm*—Watson, Cole, Grindle & Watson

[57] ABSTRACT

A shoe sole includes a body portion which extends from a toe end of the shoe to a heel end and either two inflatable tubes that extend along the sides of the body portion or a single inflatable tube that extends around the periphery of the body portion so as to define an elongated recess that exposes the bottom surface of the body portion, the fluid in the inflatable tube(s) moving therewithin when more load is applied on one side of the shoe defining use than the other.

14 Claims, 3 Drawing Sheets

SHOE WITH SOLE THAT INCLUDES INFLATABLE PASSAGES TO PROVIDE CUSHIONING AND STABILITY

This invention relates to shoes, and more particularly to the soles of shoes.

An object of the invention is to provide a shoe with an improved sole for contact with the ground by providing the sole with inflatable passage means.

In general the invention provides a shoe having a sole which includes inflatable passage means comprising respective continuous passages extending lengthwise of the sole adjacent each side thereof, and means for enabling fluid to be supplied to the passage means for the inflation thereof. Preferably, the underside of the sole is provided with a lengthwise extending recess bounded by the continuous passages extending on each side of the sole.

The passage means may extend completely around the periphery of the sole, such an arrangement being particularly advantageous for orthopaedic shoes, where, in use, the inflated passage means provide both a cushioning effect and stability for the user.

Alternatively, the passage means may comprise two spaced continuous passages which extend one on each side of the shoe to respective closed ends at or adjacent the toe end portion of the shoe, the other ends being interconnected to allow the transfer of the fluid therebetween. Such an arrangement is particularly advantageous for sports shoes, especially athletics shoes.

In such an arrangement, the passages are preferably interconnected by a reservoir disposed in the heel. end portion of the shoe. The reservoir may comprise chamber disposed in a heel portion of the sole. Alternatively, the reservoir may comprise a U-shaped passage at the heel end portion of the shoe. The means for enabling fluid to be supplied to the passage means for inflating the latter preferably comprises a valved inlet to the reservoir.

Preferably the passage are provided with means preventing or at least restricting their inflation at the portions thereof adjacent the reservoir.

The passages may comprise inflatable tubing, and in such a case, the wall of the tubing may be thickened or reinforced at the portions thereof adjacent the reservoir to prevent or restrict inflation of the tubing. The tubing may be contained within a protective covering therefore which is disposed for contatct with the ground when the shoe is being used. In this case, the covering may be dimensioned to prevent or restrict inflation of the tubing at the portions thereof adjacent the reservoir.

As an alternative to using inflatable tubing for the passages, the passages may be formed by cavities in one or more mouldings forming the sole. In this case, the wall thickness of the cavities of the portions of the passages adjacent the reservoir may be made greater than the wall thicknesses of the cavities remote from the reservoir, at least on the underneath of the sole to restrict inflation of the first mentioned portion of the passages.

In order that invention may be well understood, some embodiments thereof, which are given by way of example only, will now be described, with reference to the accompanying drawings in wnhich:

Figure 1:
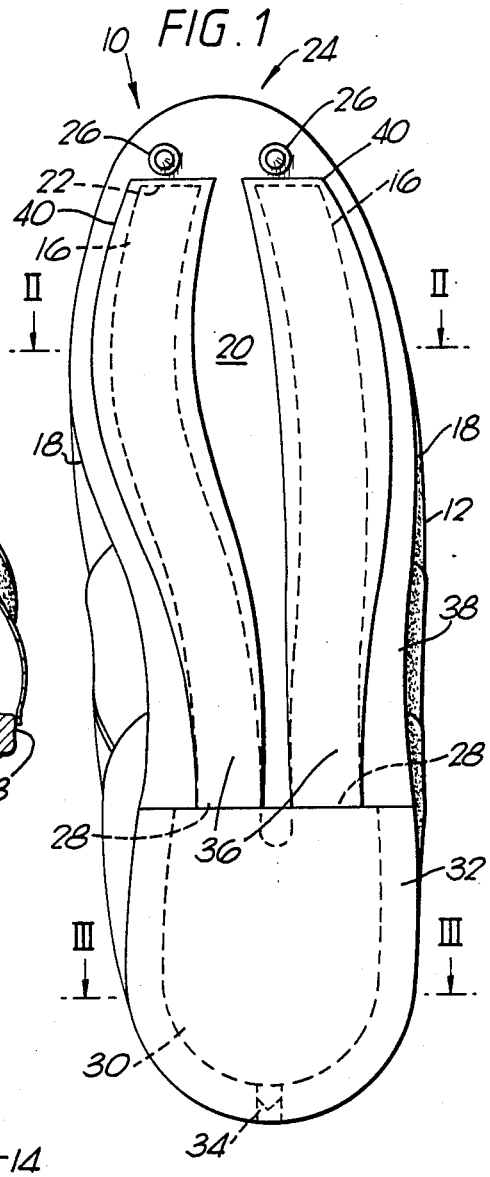
FIG. 1 is a sketch showing the underside of an athletics shoe.
Figure 2:
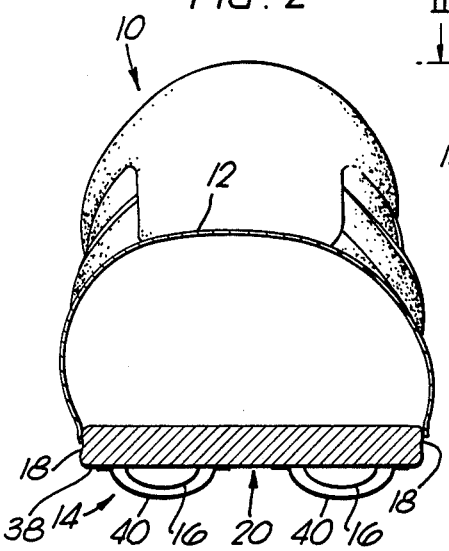
FIGS. 2 and 3 are respectively sketches of cross-sections of the shoe taken along the lines II—II and III—III in FIG. 1.
Figure 3:
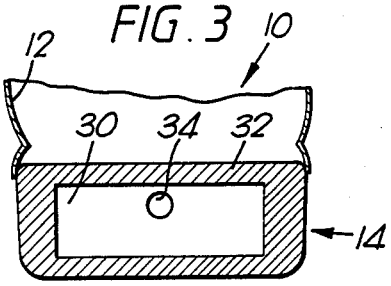
Figure 4:
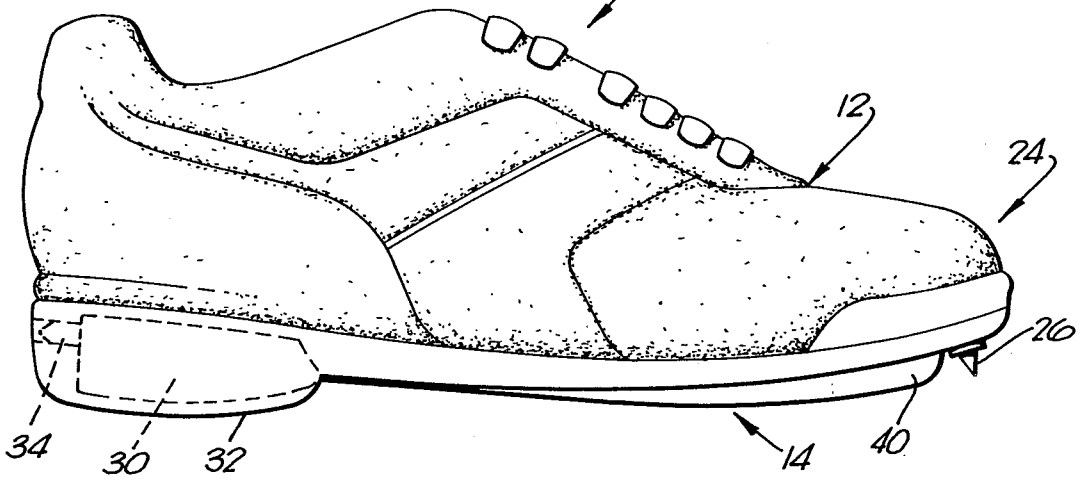
FIG. 4 is a side view of the same shoe.

Referring first to FIGS. 1 to 4, there is shown an athletics shoe 10 comprising essentially an upper 12 and a sole 14.

In this connection, it is to be understood that in this specification the term 'sole' refers to the whohle of the bottom of the shoe including any heel which may be provided.

The sole includes inflatable passage means formed as two spaced passages 16 extending lengthwise of the sole adjacent each side 18 thereof. The passages 16 are continuous along their length. As illustrated the underside of the sole 14 is provided with a lengthwise extending recess 20 bounded by the two spaced passages 16. The passages 16 have closed ends 22 at, or as illustrated adjacent, the toe end portion 24, wherat, in the illustrated embodiment the sole is provided with two sppikes 26. The other ends 28 of the passages 16 are interconnected to allow the transfer of fluid therebetween. These ends 28 are interconnectetd via a reservoir disposed at the heel end portion of the shoe and formed as a chamber 30 in a heel portion 32 of the sole. A valved inlet 34 to the resevoir forms a means for enabling fluid to be supplied to the passages 16. For example the valved inle may be of the type which is connectable via an adapter to a hand operated pneumatic pump.

The passages are provided with means preventing or restricting their inflation at the portions 36 thereof disposed between the ball portion and heel end portion of the shoe adjacent the reservoir and corresponding to that part of the sole which flexes in use. In the embodiment the passages 16 are formed from inflatable tubing and this tubing is thickened or reinforced (for example by a winding of tape) at the portions 36 to prevent or at least restrict the inflation of the tubing at these portions. The tubing forming each passage 17 is secured to the underside of a body portion 38 of the sole and is contained within a covering 40 also secured to the underside of the body portion 38 of the sole and disposed for contact with the ground. The covering 40 is made of a substantially non-stretchable material of good grip and wear characteristics and may for example comprise a canvas material impregnated with a rubber or flexible plastic material.

Prior to use of the shoe, air is pumped into the reservoir and the tubing 16 connected thereto via the valved inlet 34. The portions 36 of the tubing whose inflation is restricted remain flexible so as not to unduly stiffen the sole in this region, but the portions of the tubing remote from the reservoir and extending over that part of the sole which supports the ball of the foot can inflate into engagement with the covering 40 thereat. The air pressure in the tubing determines the degree of hardness or softness of the contact of the sole with the ground over these portions and can be adjusted to suit the user's preference. The above-described shoe has been found to have advantageous characteristics in use since the air in the passages 16 is transmitted lengthwise thereof into and out of the reservoir 30 each time the shoe contacts the ground during running and also between the passages 16 via the reservoir when more load is exerted on one side of the sole than the other, for example when the user is running around a bend.

Figure 5:
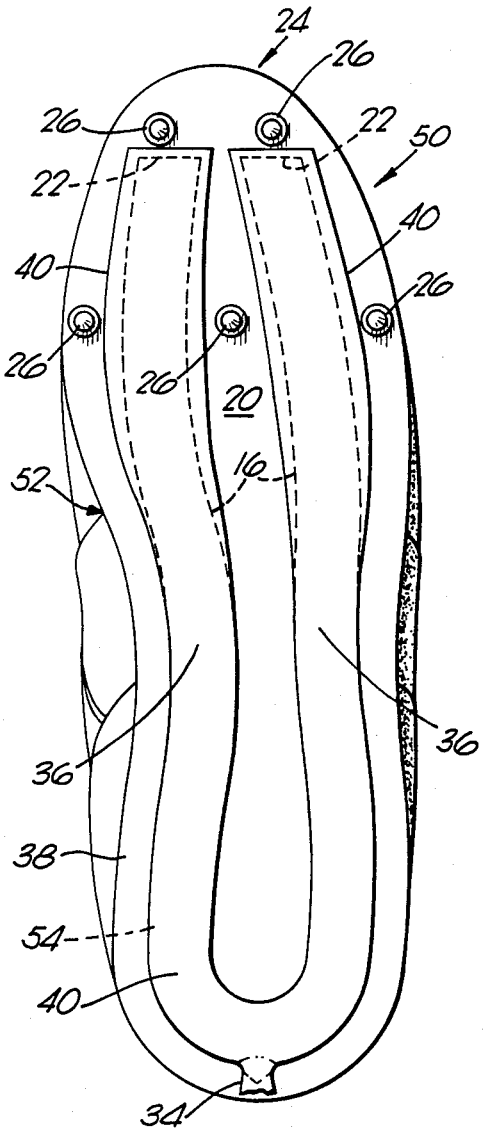
FIG. 5 is a sketch showing the underside of another athletics shoe.

A shoe 50 whose underside view is shown in FIG. 5 is an athletics shoe designed for sprinting where the sole 52 is not provided with a heel portion. Parts of the sole 52 which correspond to parts of the sole 14 in FIGS. 1 to 4 have been given like reference numerals. The sole 52 differs from the sole 14 primarily in that the two spaced passages 16 which extend on each side of the shoe with the recess 20 therebetween have their portions 36 interconnected by a U-shaped passage 54 at the heel end portion of the shoe forming a reservoir corresponding to reservoir chamber 30.

A single piece of inflatable tubing provides the passages 16 and passage 54. The covering 40 which covers the tubing is dimensioned to prevent or at least restrict the inflation of the tubing at portions 36 of the passages 16 and additionally at the passage 54 forming the reservoir but to allow inflation of the portions of the tubing remote from the reservoir and extending over that part of the sole which supports the ball of the foot. Thus, as in the first embodiment the air pressure in the tubing determines the degree of hardness or softness of the contact of the sole with the ground over these latter portions, the portions 36 remaining flexible so as not to unduly stiffen the sole in the region where they are located.

It will be appreciated that the sole 52 functions in the same way as the sole 14 in that air in the passages 16 is transmitted lengthwise of these passages into and out of the reservoir each time the shoe contacts the ground during running and also between the passages 16 via the reservoir when more load is exerted on one side of the sold than the other.

Figure 6:
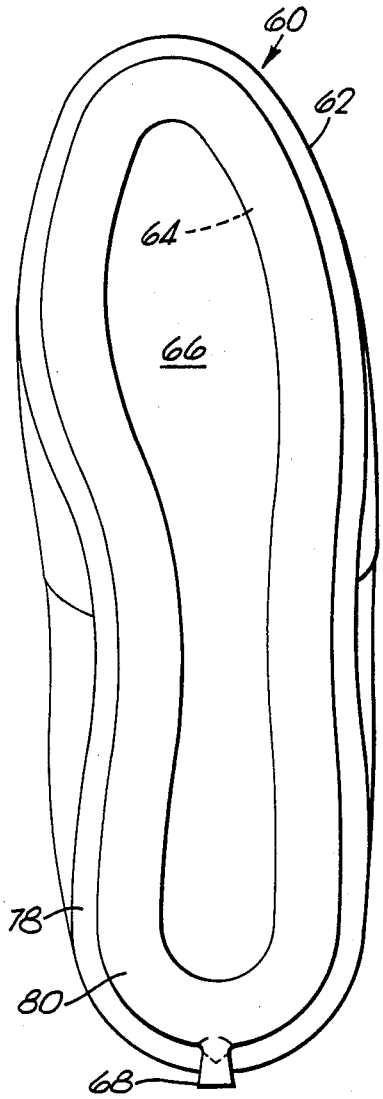
FIG. 6 is a sketch showing the underside of an orthopoedic shoe.

Referring now to FIG. 6, the orthopoedic shoe 60 illustrated is provided with a sole 62 which includes inflatable passage means 64 which extend not just lengthwise of and on each side of the shoe but around the entire periphery of the sole. This passage means 64 bounds a lengthwise extending recess 60 on the underside of the sole.

The passage means 64 comprises an inflatable tubuler member (not shown) which is provided with a valved inlet 68 at the heel end portion of the shoe. The tubular member is secured to the underside of a body portion 78 of the sole and contained within a covering 80 also secured to the underside of the body portion 78 of the sole and disposed for contact with the ground. The covering 80, like the covering 40 previously referred to is made of a substantially non-stretchable material of good grip and wear characteristics. In this shoe however, the covering 80 does not selectively restrict the inflation of the tublar member and accordingly when the tubular member is inflated into engagement with the covering 80 a uniform degree of hardness or softness of the contact of the sole with the ground is obtained. Thus, by adjusting the degree of inflation of the tubular member a desired cushioning effect can be obtained. Stability is also provided by arranging for the tubular member to extend around the entire periphery of the sole.

Whilst the above described embodiments utilise inflatable tubing for providing inflatable passages it is to be understood that these passages may instead be formed by cavities defined in or by one or more mouldings forming the sole. Further, as indicated hereinabove, when the passages are so formed, the wall thickness of the cavities of the portions corresponding to the portions 36 in the first and second embodiments may be made greater than the wall thicknesses of the cavities of the portions of the passages extending over that part of the sole which supports the ball of the foot so that whilst the latter portions are able to inflate, the former portions are not.

It will be apprciated that whilst certain materials have been specified above in the embodiments, these are given by way of example only and other suitable materials could be used instead.

Further it is to be understood that the valved inlet in the embodiments may be of any suitable known type, for example such as that conventionally used for cycle inner tubes or such as that conventionally used for soccer balls. The latter type is presently preferred since it is adapted to be housed within the sole structure.

I claim:

1. A shoe which defines a toe end and a heel end and which includes a sole that comprises a body portion which extends from said toe end of said shoe to said heel end and which defines opposite sides and a bottom surface; elongated first and second inflatable passage means respectively extending along said body portion adjacent said opposite sides thereof, each of said first and second inflatable passage means extending from forward ends which are not interconnected to rearward ends near said heel end of said shoe, thereby providing an elongated recess therebetween which exposes said bottom surface of said body portion; means at said heel end interconnecting said rearward ends of said first and second inflatable passage means to enable fluid to flow therebetween when, during use of the shoe, more load is applied on one of said first and second inflatable passage means than the other; and means for supplying fluid to said first and second inflatable passage means.

2. A shoe as claimed in claim 1, wherein said first and second inflatable passages means comprise first and second inflatable tubes positioned against said bottom surface of said body portion, and wherein an elongated covering means covers each of said first and second inflatable tubes, said covering means being attached along opposite sides thereof to the bottom surface of said body portion.

3. A shoe as claimed in claim 1, wherein the passages are interconnected by a reservoir disposed at the heel end portion of the shoe.

4. A shoe as claimed in claim 3, wherein the reservoir comprises a chamber disposed in a heel portion of the sole.

5. A shoe as claimed in claim 3, wherein reservoir comprises a U-shaped passage at the heel end portion of the shoe.

6. A shoe as claimed in claim 3, wherein said means for enabling fluid to be supplied to he passage means comprises a valved inlet to said reservoir.

7. A shoe as claimed in claim 3, wherein said passages are provided with means for preventing or at least restricting their inflation at portions thereof adjacent the reservoir.

8. A shoe as claimed in claim 7, wherein the passages comprises inflatable tubing, the wall of the tubing being thickened or reinforced at the portions thereof adjacent the reservoir to prevent or restrict inflation of the tubing.

9. A shoe as claimed in claim 7, wherein the passages comprise inflatable tubing which is contained within a protective covering therefor which is disposed for contact with the ground when the shoe is being used, the protective covering being dimensioned to prevent or retrict inflation of the tubing at the portions thereof adjacent the reservoir.

10. A shoe as claimed in claim 7, wherein the passages are formed by cavities in one or more mouldings forming the sole, the wall thickness of the cavities forming the portions of the passage adjacent the reservoir being greater than the wall thicknesses of the cavities remote from the reservoir at least on the underneath of the sole to restrict inflation of the first-mentioned portions of the passages.

11. A shoe as defined in claim 1, wherein said first and second inflatable passage means and said means at said heel end which interconnects said rearward ends of said first and second inflatable passage means are portions of a single inflatable tube.

12. A shoe which defines a toe end and a heel end and which includes a sole for contact with the ground that extends from said toe end to said heel end of said shoe, said sole including two spaced inflatable passages extending lengthwise of the sole, one on each side thereof, to respective closed ends adjacent the toe end of the shoe, the pasages being interconnected at a heel end portion of the shoe to allow the transfer of fluid therebetween but being otherwise uninterconnected, and the passages being provided with means at least restricting their inflation at portions disposed between a ball portion of the shoe and the heel end portion thereof.

13. A shoe which defines a toe end and a heel end and which includes a sole that extends from said toe end of said shoe to said heel end and which comprises a body portion which has a bottom surface and which defines a periphery; an inflatable passage means which is located on said bottom surface of said body portion and extends around said periphery of said body portion, thereby providing an elongated recess therewithin which exposed said bottom surface of said body portion, a portion of said inflatable passage means extending around a heel end portion of the body portion; and means for supplying fluid to said inflatable passage means.

14. A shoe as claimed in claim 13, wherein said inflatable passage means comprises an inflatable tube, and wherein a covering means covers said inflatable tube, said covering means being attached along opposite sides thereof to the bottom surface of said body portion.

* * * * *